US005117220A

United States Patent [19]

Marino et al.

[11] Patent Number: 5,117,220

[45] Date of Patent: May 26, 1992

[54] GLASS BREAKAGE DETECTOR

[75] Inventors: Francis C. Marino, Dix Hills; Stanley B. Freeman, Jericho, both of N.Y.

[73] Assignee: Pittway Corporation, Syosset, N.Y.

[21] Appl. No.: 653,887

[22] Filed: Feb. 11, 1991

[51] Int. Cl.[5] ..... G08B 13/00

[52] U.S. Cl. ..... 340/550; 340/566

[58] Field of Search ..... 340/550, 566; 310/334, 310/338

[56] References Cited

U.S. PATENT DOCUMENTS 4,091,660 5/1978 Yanagi ..... 340/550 X
4,180,811 12/1979 Yoshimura et al. ..... 340/566
4,195,286 3/1980 Galvin ..... 340/501
4,383,250 5/1983 Galvin ..... 340/521
4,668,941 5/1987 Davenport et al. ..... 340/550
4,853,677 8/1989 Yarbrough et al. ..... 340/550 X
4,928,085 5/1990 DuRand, III et al. ..... 340/566 X

*Primary Examiner*—Jin F. Ng
*Assistant Examiner*—Thomas J. Mullen, Jr.
*Attorney, Agent, or Firm*—Ladas & Parry

[57] ABSTRACT

A glass breakage detector utilizes a single microphone or piezoelectric element as a transducer to detect both the structurally-transmitted vibrations and airborne sounds indicative of breaking glass. The structurally transmitted component and airborne component are combined in accordance with a time-dependent function to provide an indication of breaking glass which has a low false alarm rate.

23 Claims, 4 Drawing Sheets $f_0 \approx 5\text{-}7\,KHZ$ $f_0 \approx 200\,HZ$

GLASS BREAKAGE DETECTOR

BACKGROUND OF THE INVENTION

This invention relates to a method and apparatus for detecting the breakage of glass.

Detecting glass breakage is important in securing buildings from illegal entry. It is well known that illegal entry into buildings can be obtained by breaking the glass of a window and reaching in to open the window. Illegal entry may also be obtained by breaking glass panels on or around a door and then reaching in to unlock the door and thus gain entry. The entire window or glass doors may be shattered in order to gain illegal entry. Thus, there is considerable interest in providing security systems for these buildings with a means to detect the breaking of glass.

Glass breakage detectors are known in the art. Vibrational type glass breakage detectors are either installed on the frame of the glass or on the glass itself. These type of detectors are not easy to install because they must receive sufficient energy when impact is applied to the glass to produce an alarm but not be overly sensitive to other vibrations which may be transmitted through the structure or be airborne transmitted. Furthermore, these sensors are difficult to test because a true test involves shattering the glass which is impractical. Thus, adjusting the sensitivity of these devices can be difficult and require repeat adjustments if false alarms are a problem. Glass mounted detectors of this type are limited to a single pane and thus one sensor is required for each pane in multi-partitioned glass.

Sound discriminator type sensors are much easier to install but are prone to false alarms because of the fact that the useful frequencies and energy levels of airborne-generated sounds of breaking glass are also commonly generated by many sources in a typical home or business such as radios, human speech, the moving of furniture, normal handling of desk components, files, dishes, pots, pans, drinking glasses or similar articles.

More recently sound discriminators which incorporate two transducers have become available. Each of these transducers respond to one of the two major acoustical energy components associated with breaking glass. The first transducer is generally an ordinary microphone which is intended to respond primarily to the higher frequencies of the airborne-generated component of breaking glass. The other transducer is quite different and is specially designed to respond to the lower-frequency structurally-generated component. By utilizing two transducers, each detecting a different component of breaking glass, these devices minimize the probability of false alarms without sacrificing effective glass breakage detection when it truly occurs within range of the detector.

U.S. Pat. No. 4,195,286 which issued on Mar. 25, 1980 to Aaron Galvin discloses the principle of using two or more transducers or sensors for the purpose of providing redundancy in an alarm system to reduce the probability of false alarms. In this system, the outputs of the two transducers are fed into a OR circuit which produces a local alarm. Each of the outputs is also fed to a multivibrator to produce a longer duration pulse which is then fed to a AND circuit which produces a second alarm, possibly at a remote location, such as an alarm monitoring station, if both transducers are activated during a predetermined time period.

U.S. Pat. No. 4,383,250 which issued on May 10, 1983 to Aaron Galvin discloses how one or two transducers may be utilized to differentiate between tampering.

SUMMARY OF THE INVENTION

It is a general object of the present invention to provide a method and apparatus for detecting breaking glass.

It is a further object of the invention to provide a method and apparatus for detecting breaking glass which is highly reliable.

Yet another object of the invention is a method and apparatus for detecting breaking glass which requires only a single transducer.

Another object of the invention is a method and apparatus for detecting breaking glass which combines vibrations or sounds produced by the impact on the glass which are transmitted by the structure with airborne-transmitted sounds produced by the breaking of the glass.

A still further object of the invention is a method and apparatus for detecting breaking glass in which the vibrations or sounds produced by impact on the glass which are transmitted by the structure are combined in a time-dependent Boolean AND function with the airborne-transmitted sounds of the breaking of the glass.

These and other objects of the invention are attained, in accordance with one aspect of the invention, by a method detecting breaking glass comprising detecting by said transducer means structurally-transmitted vibrations of impact on glass for generating a first signal; detecting by said transducer means airborne-transmitted sounds emitted by breaking glass for generating a second signal; combining said first and second signals in accordance with a time-dependent function to generate an alarm signal indicative of breaking glass.

Another aspect of the invention includes apparatus for detecting breaking glass comprising a transducer for detecting structurally-transmitted vibrations of impact on glass and airborne-transmitted sounds emitted by breaking glass and having an output signal. A circuit is coupled to the transducer for combining, in accordance with a time-dependent function, information in the output signal information in the output signal indicative of said airborne-transmitted sounds for generating an alarm signal indicative of breaking glass.

A further aspect of the invention includes apparatus for detecting breaking glass comprising a single microphone transducer for detecting structurally-transmitted vibrations of impact on glass and airborne-transmitted sounds emitted by breaking glass and having an output signal. A circuit is coupled to the transducer for combining information in the output signal indicative of the structurally-transmitted vibrations with information in the output signal indicative of the airborne-transmitted sounds for generating an alarm signal indicative of breaking glass.

DETAILED DESCRIPTION

Figure 1:
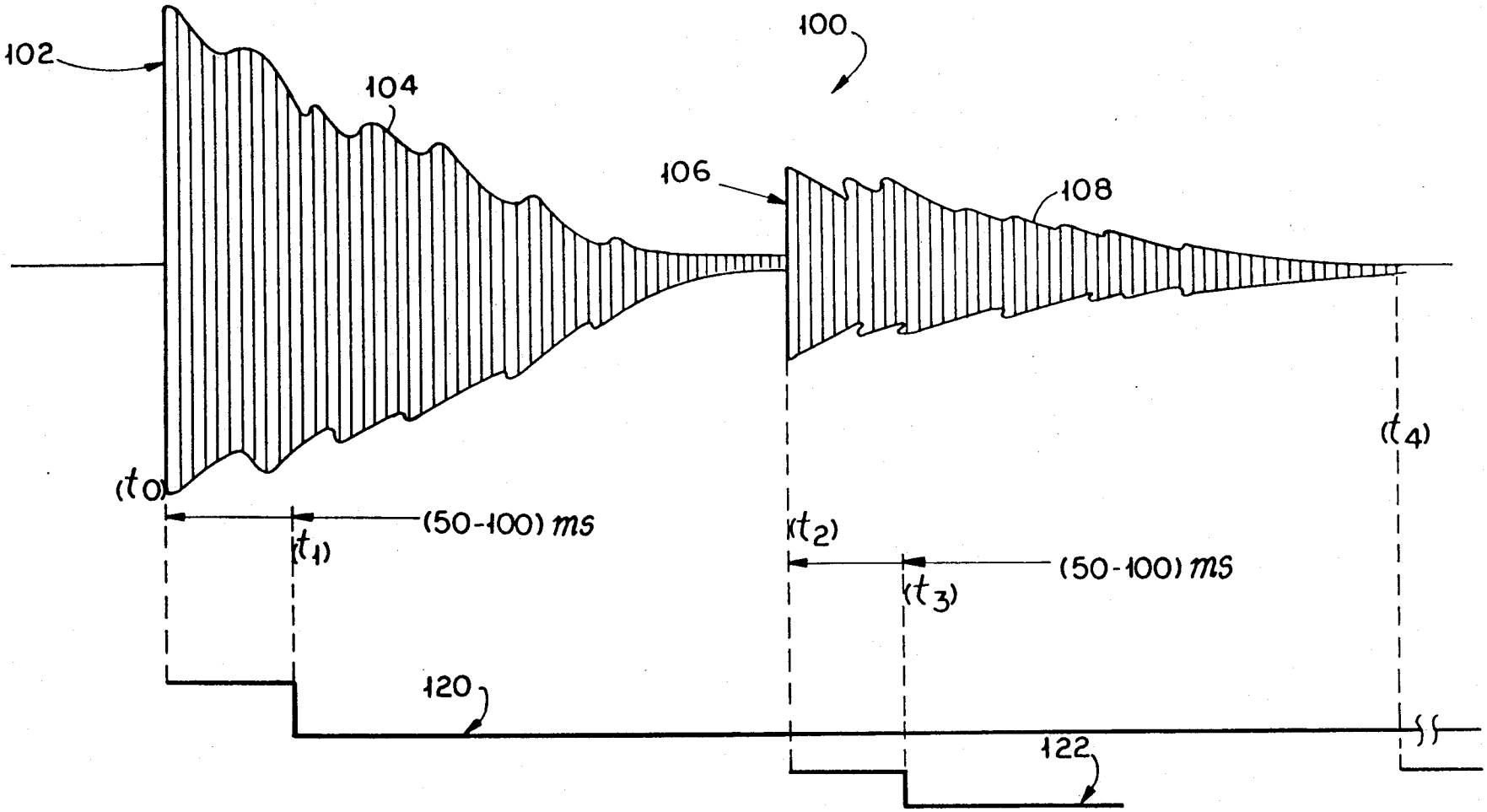
FIG. 1 shows the envelope of the waveform of the sounds produced by an impact on glass and produced by the breaking of the glass.
Figure 3:
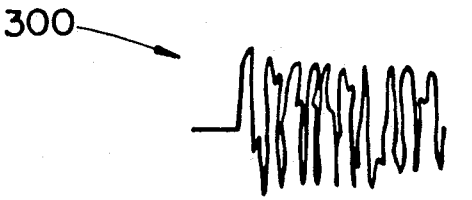
FIG. 3 shows the waveform of the sound signal at time $t_3$ FIG. 1.
Figure 2:
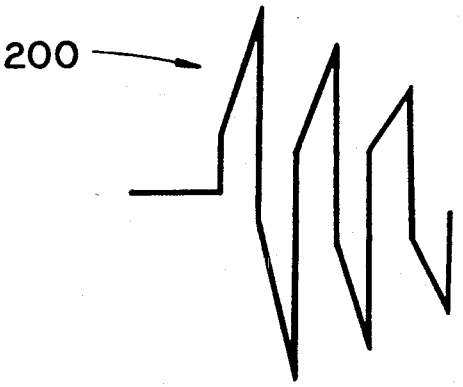
FIG. 2 shows the waveform of the sound signal at time $t_1$ of FIG. 1.

Applicants have discovered that the acoustic energy profile of breaking glass comprises two distinct events which produce two distinct signals which are separated in time and do not overlap. Referring to FIG. 1, the typical energy profile of breaking glass as generated by a single microphone is approximated by the signal 100. At time $t_0$ the glass is impacted which produces the waveform 102. The signal then gradually decreases as shown by the envelope 104. As shown in FIG. 2, the vibrational component at time $t_1$, which occurs approximately 50-100 milliseconds after impact, appears primarily as a damped low frequency waveform having a frequency of approximately 200 Hz. This damping aspect may be explained as a decreasing low frequency vibration between the glass and the impacting object gradually giving way to an increasing deflection of the glass, see FIG. 1. When the glass is deflected beyond its breaking point it shatters, as illustrated at time $t_2$ in FIG. 1. When the glass shatters it emits a high frequency sound, shown at 106, which travels primarily through the air. This high frequency is typically in the 3 to 7 KHz frequency range. The signal 106 decays as shown by envelope 108 until time $t_4$. The waveform at time $t_3$, approximately 50 to 100 milliseconds after the glass shatters, is shown as 300 in FIG. 3. It has a frequency of approximately 5-7 KHz.

The vibrational component between time $t_0$ and time $t_2$ lasts approximately 500 milliseconds. The shattering high frequency component from time $t_2$ to time $t_4$ also lasts for approximately 500 milliseconds, but has an energy level which is lower than the vibrational components.

Applicants have discovered that the differences in frequency, energy level and time of occurrence between both of these acoustic components can be utilized by electronic circuit to produce output signals signifying the , detection of breaking glass, which is highly immune from ; false alarms. Furthermore, the circuit can utilize a single transducer or microphone to significantly reduce the cost of the detector.

Figure 4:
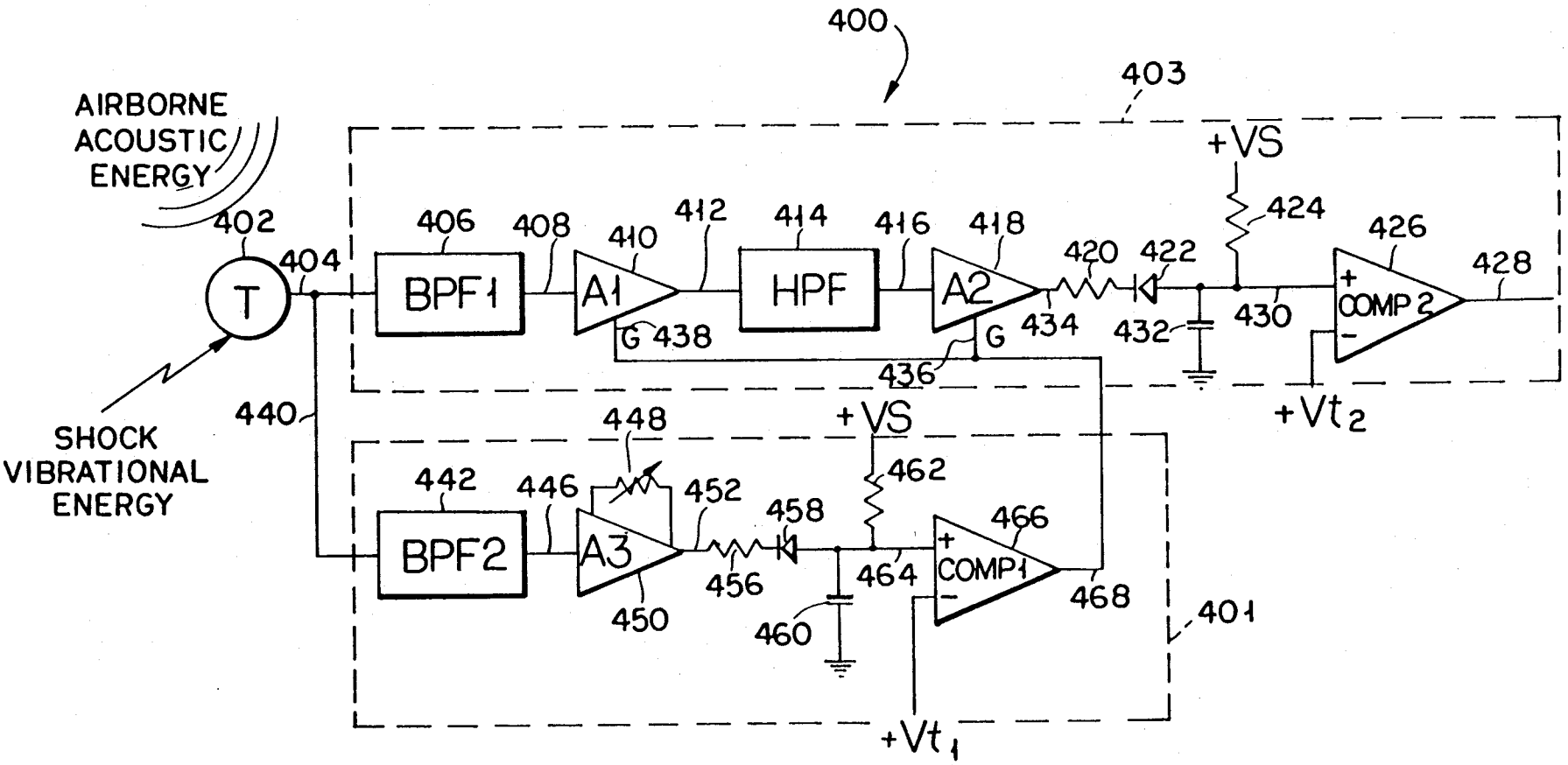
FIG. 4 is a block diagram of a glass breakage detection circuit according to the present invention.
Figure 6:
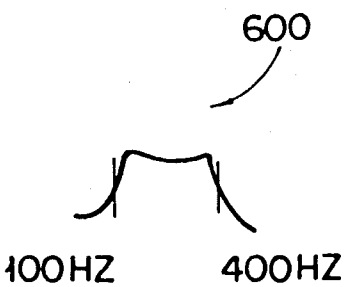
FIG. 6 is a diagram of the passband characteristics of the filter 442 of FIG. 4.

Referring to FIG. 4, a circuit in accordance with the present invention is generally shown as 400. The circuit uses a single transducer 402 which is preferably a microphone or piezoelectric element for receiving both the airborne acoustic energy and shock vibrational energy produced by the breaking of glass, as shown in FIG. 1. The utilization of a single transducer reduces the cost of the glass breakage detector. The output of the transducer is coupled via lines 404, 440 to first processing channel 401. Channel 401 processes the low frequency vibrational energy 104 produced by the shock waves transmitted through the structure in which the glass is mounted. The output of the transducer is coupled to a bandpass filter 442. The bandpass filter is designed to pass only the frequencies which are indicative of the shock vibrations. The bandpass characteristics of bandpass filter 442 is shown in FIG. 6 at 600. As can be seen in FIG. 6, the filter has a typical characteristic of bandpass filter with a lower limit (3 db point) of 100 Hz and upper limit (3 db point) of 400 Hz. The output of the bandpass filter is coupled via line 446 to amplifier 450. Amplifier 450 is preferably an integrated circuit operational amplifier having a variable resistor 448 in order to adjust the sensitivity of this channel for a particular installation. The design of such operational amplifiers is well known to those skilled in the art and need not be described in detail here.

The output of amplifier 450 is coupled via line 452 through resistor 456 in series with diode 458 to line 464 into the input of comparator 466. A resistor 462 is coupled from a source of voltage VS to the input of the comparator and a capacitor 460 is coupled from the input of the comparator to ground. Resistors 456 and 462, diode 458 and capacitor 460 form an integrator and pulse stretcher as is well known to those skilled in the art.

Comparator 466 has a second input coupled to a source of threshold voltage $Vt_1$ and an output 468. The output 468 is coupled to the gates of gated amplifiers 410 and 418 via lines 438 and 436, respectively.

Figure 7:
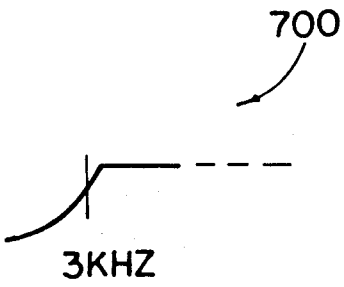
FIG. 7 is a diagram of the high pass characteristic of filter 414 of FIG. 4.
Figure 5:
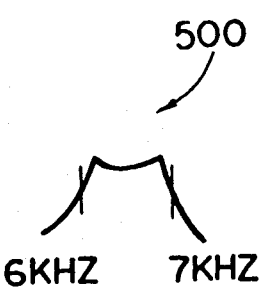
FIG. 5 is a diagram of the passband characteristics of bandpass filter 406 of FIG. 4.

The operation of channel 1 will now be described. The output of comparator 466 is normally high which disables amplifiers 410 and 418. When the low frequency vibrational acoustic energy of the impact on the glass reaches the transducer 402 it is applied to bandpass filter 442. If it is of the proper frequency range of 100-400 Hz, it is applied to amplifier 450. Capacitor 460 has been charged to the positive voltage VS through resistor 462. The output of amplifier 450 causes the capacitor 460 to discharge through the resistor 456 and diode 458, thus decreasing the voltage present at the first input to the comparator 466. When the voltage on capacitor 460 decreases below the threshold voltage $Vt_1$, the output of the comparator goes low, which enables amplifiers 410 and 418. The time constant of the RC circuit comprising resistor 456 and capacitor 460 is chosen so that this occurs 50-100 milliseconds after the initial impact on the glass, which is shown as time $t_1$ in FIG. 1. In FIG. 1 waveform 120 is the output of comparator 466 on line 468. At time $t_1$, this output drops from the high level that it has been at time $t_0$ to a low level as shown in FIG. 1. Signal 120 being applied to the gates 438 and 436 of amplifiers 410 and 418, respectively "opens" the second channel, labeled as 403 in FIG. 4. This channel processes the airborne acoustic component 108 which arrives at the transducer delayed in time from the original vibrational component, as shown in FIG. 1. The output of transducer 402 is applied via line 404 to bandpass filter 406. Bandpass filter 406 has a characteristic shown at 500 in FIG. 5. As shown in FIG. 5, the bandpass characteristic is a typical bandpass characteristic having a lower limit (3 db point) of 6 KHz and an upper limit (3 db point) of 7 KHz. The output of the bandpass filter on line 408 is substantially limited to the frequency range of interest as being indicative of the acoustic component of breaking glass. It is applied to gated amplifier 410 which has now been gated on by the output of comparator 466. The amplified signal is then applied via line 412 to high pass filter 414 which has characteristic 700 shown in FIG. 7. As can be seen from FIG. 7 the characteristic of filter 414 is typical for that of a high pass filter and has a lower limit (3 db point) of approximately 3 KHz. The output of the high pass filter is applied via line 416 to gated amplifier 418 which has been gated on by the output of comparator 466. The output of amplifier 418 is applied via line 434 to resistor 420 in series with diode 422 to line 430 which is one input of comparator 426. A resistor 424 is coupled at one end to a source of power VS having its second end connected to line 430. A capacitor 432 is coupled from line 430 to ground. Resistors 420 and 424, diode 422 and capacitor 432 form an integrator and pulse stretcher similar to that previously described in connection with the description of channel 1. Again, the time concept of this circuit is chosen to be 50–100 25 milliseconds so that the output is delayed to time $t_3$ shown in FIG. 1. A second input to comparator 432 is a source of threshold voltage $Vt_2$. The output of the comparator on line 428 is an alarm signal which can be used to trigger other circuits (not shown) for reporting the intrusion. Gated amplifiers 410, 418 and comparators 426, 466 are preferably integrated circuit components of known design. High pass filter 414 represents the bandpass of the AC sufficient gain can be obtained in amplifier 410 alone, amplifier 418 can be eliminated, which will eliminate the need for the high pass filter 414 which couples the two amplifiers.

The operation of the second channel 403 is as follows. The signal 120 on line 466 gates amplifiers 410 and 418 on at time $t_1$. Channel 403 is thus open to receive the high frequency airborne component when it occurs, starting time $t_2$. When the airborne acoustic sounds arrive at transducer 402, they pass through bandpass filter 406 which limits the frequency response of the channel to those frequencies which are indicative of breaking glass. The signal on line 408 passes through amplifier 410 and high pass filter 414 and supplied to the second gated amplifier 418. The output of gated amplifier 418 is delayed by approximately 50–100 milliseconds, as described in connection with the first channel 401 and as indicated at time $t_3$ in FIG. 1. When the voltage on capacitor 432 is reduced below threshold voltage the $Vt_2$ at time $t_3$ the voltage on line 428 goes from high to low as shown in waveform 122 (see FIG. 1) which illustrates the output on line 428.

The time delays between times $t_0$ and time $t_1$ and time $t_2$ and $t_3$ are necessary to assure that the acoustical vibrational component is present long enough to exclude extraneous noises. As shown in FIG. 1 the vibrational component 104 can approach zero before the glass shatters. Accordingly, it is necessary to stretch the gating signal applied to the gates 438 and 436 of amplifiers 410 and 418 respectively in order that the channel remain open when the airborne acoustic signal arrives. This "stretching" of the output of comparator 466 is produced by properly choosing resistor 462 and capacitor 460 so that the signal on line 420 will last approximately one second. As shown in FIG. 1, the signals 104 and 108 each last approximately 500 milliseconds and the signal shown on line 120 lasts longer than that in order to guarantee detection of the airborne acoustic component. As shown in FIG. 1, the output of comparator 426 is "stretched" to assure a minimum alarm signal duration.

The utilization of the first channel 401 to produce a time-delayed and "stretched" signal to gate the second channel 403 effectively produces a time-dependent Boolean AND gate function for the two outputs (airborne and structurally-borne) of transducer 402.

The present invention provides an effective means of detecting glass breakage with a low false alarm rate because of the sequential requirement to detect first a low frequency wave of sufficient energy for at least 50 to 100 milliseconds which corresponds to the impact on the glass. Then a signal indicating the detection of the low frequency or structurally-borne component is stretched in time in order to produce a delayed gating signal for the second channel which amplifies the high frequency sounds corresponding to the shattering of glass. The final output signal indicating the breakage of glass is itself delayed 50 to 100 milliseconds in order to insure that the airborne component has existed for a long enough period of time to eliminate transient in-band sources of sound. The time-dependent combination of the vibrational and airborne components characteristic of breaking glass adds a time differentiation of the sounds associated with breaking glass. This helps distinguish the sound of breaking glass from those commonly generated in the home, office, or plant and thus substantially reduces the false alarm rate of a glass breakage detector. The utilization of a single transducer 402 reduces the cost of the detector without reducing its ability to detect breaking glass or its ability to have the low false alarm rate.

What is claimed is:

1. A method of detecting breaking glass comprising:

detecting by said transducer means structurally-transmitted vibrations of impact on glass for generating a first signal;

gating a circuit in said transducer means responsive to said first signal to enable detection by said transducer means of airborne-transmitted sounds;

detecting by said transducer means airborne-transmitted sounds emitted by breaking glass for generating a second signal; and combining said first and second signals in accordance with a time-dependent function to generate an alarm signal indicative of breaking glass.

2. The method according to claim 1 wherein said detecting of said structurally-transmitted vibrations and airborne-transmitted sounds is performed by a single transducer.

3. The method according to claim 1 wherein said first signal is of longer duration than said structurally-transmitted vibrations.

4. The method according to claim 3 wherein generation of said first signal is delayed until said structurally-transmitted vibrations have been detected for a first predetermined time interval.

5. The method according to claim 4 wherein generation of said second signal is delayed until said airborne-transmitted sound.., have been detected for a second predetermined time interval.

6. The method according to claim 5 wherein said first and said second predetermined time intervals are substantially equal in duration.

7. The method according to claim 6 wherein said first and second time intervals are in the range of substantially 50–100 milliseconds.

8. The method according to claim 1 wherein said gating by said first signal provides a time-dependent Boolean AND function.

9. The method according to claim 1 wherein said structurally-transmitted vibrations utilized to generate said first signal are limited to a bandpass of substantially 100–400 Hz.

10. The method according to claim 9 wherein said airborne-transmitted sounds utilized to generate said second signal are limited to a bandpass of substantially 6–7 KHz.

11. Apparatus for detecting breaking glass comprising:

transducer means for detecting structurallytransmitted vibrations of impact on glass and airborne-transmitted sounds emitted by breaking glass and having an output signal;

circuit means coupled to said transducer means for generating a first signal in response to said structurally-transmitted vibrations, said first signal gating a filter circuit for receiving said airborne-transmitted sounds and for combining in accordance with a time-dependent function information in said output signal indicative of said structurally-transmitted vibrations with information in said output signal indicative of said airborne-transmitted sounds for generating an alarm signal indicative of breaking glass.

12. Apparatus according claim 11 wherein said transducer means comprises a single transducer.

13. Apparatus according to claim 12 wherein said transducer comprises a microphone.

14. Apparatus according to claim 12 wherein said transducer comprises a piezoelectric element.

15. The apparatus according to claim 12 wherein said first signal is of longer duration than said structurally-transmitted vibrations.

16. The apparatus according to claim 15 wherein said circuit means delays generation of said first signal until said structurally-transmitted vibrations have been detected for a first predetermined time interval.

17. Apparatus according to claim 16 wherein said filter circuit generates a second signal in response to said airborne-transmitted sounds.

18. The apparatus according to claim 17 wherein said filter circuit delays generation of said second signal until said airborne-transmitted sounds have been detected for a second predetermined time interval.

19. The apparatus according to claim 18 wherein said first and said second predetermined time intervals are substantially equal in duration.

20. The apparatus according to claim 19 wherein said first and second time intervals are in the range of substantially 50–100 milliseconds.

21. The apparatus according to claim 11 wherein said structurally-transmitted vibrations utilized to generate said first signal are limited to a bandpass of substantially 100–400 Hz.

22. The apparatus according to claim 17 wherein said airborne-transmitted sounds utilized to generate said second signal are limited to a bandpass of substantially 6–7 KHz.

23. Apparatus according to claim 11 wherein said gating by said first signal provides a time-dependent Boolean AND function.

* * * * *